US006324827B1

(12) United States Patent
Basu et al.

(10) Patent No.: US 6,324,827 B1
(45) Date of Patent: Dec. 4, 2001

(54) METHOD OF GENERATING POWER IN A DRY LOW $NO_X$ COMBUSTION SYSTEM

(75) Inventors: Arunabha Basu, Naperville, IL (US); Theo H. Fleisch, Houston, TX (US); Carl A. Udovich, Joliet, IL (US); Alakananda Bhattacharyya, Wheaton, IL (US); Michael J. Gradassi, Naperville, IL (US)

(73) Assignee: BP Corporation North America Inc., Chicago, IL (US)

( * ) Notice: Subject to any disclaimer, the term of this patent is extended or adjusted under 35 U.S.C. 154(b) by 0 days.

(21) Appl. No.: 08/886,352

(22) Filed: Jul. 1, 1997

(51) Int. Cl.[7] ..... F02C 3/24
(52) U.S. Cl. ..... 60/39.02; 60/39.461
(58) Field of Search ..... 60/39.02, 39.12, 60/39.461, 39.463

(56) References Cited

U.S. PATENT DOCUMENTS

| | | | |
|---|---|---|---|
| 3,697,240 | 10/1972 | Hori et al. | 44/52 |
| 3,868,817 | 3/1975 | Marion et al. | 60/39.02 |
| 3,894,102 | 7/1975 | Chang et al. | 260/668 R |
| 3,928,483 | 12/1975 | Chang et al. | 260/668 R |
| 3,959,972 | 6/1976 | Rudolph et al. | 60/651 |
| 3,986,349 | 10/1976 | Egan | 60/39.02 |
| 4,011,275 | 3/1977 | Zahner | 260/668 R |
| 4,132,065 | 1/1979 | McGann | 60/39.02 |
| 4,332,594 | 6/1982 | Zimmerman | 44/53 |
| 4,341,069 | 7/1982 | Bell et al. | 60/39.02 |
| 4,468,233 | 8/1984 | Brunderreck et al. | 44/56 |
| 4,534,772 | 8/1985 | Reichl | 44/53 |
| 4,603,662 | 8/1986 | Norton et al. | 123/1 A |
| 4,743,272 | 5/1988 | Weinberger | 44/53 |
| 4,892,561 | 1/1990 | Levine | 44/51 |
| 5,392,594 | 2/1995 | Moore et al. | 60/39.02 |
| 5,632,786 | 5/1997 | Basu et al. | 44/448 |
| 5,666,800 * | 9/1997 | Sorensen et al. | 60/39.02 |
| 5,740,667 * | 4/1998 | Bhattacharyya et al. | 60/39.02 |
| 5,819,522 * | 10/1998 | Topsoe | 60/39.02 |
| 5,906,664 | 5/1999 | Basu et al. | 44/446 |

FOREIGN PATENT DOCUMENTS

| | | |
|---|---|---|
| 2020929 | 1/1991 | (CA) . |
| 654470 | 12/1937 | (DE) . |
| 2 056 131 | 5/1972 | (DE) . |
| 0 166 096 A1 | 1/1986 | (EP) . |
| 0 324 475 A1 | 7/1989 | (EP) . |
| 2 149 113 | 3/1973 | (FR) . |
| 60-86195 | 5/1985 | (JP) . |
| WO 81/00721 | 3/1981 | (WO) . |
| WO 96/05274 | 2/1996 | (WO) . |

OTHER PUBLICATIONS

Mills, G.A. & Rostrup–Nielsen, J. *Catalysis for Electricity Applications. Catalysis Today*, vol. 22 (1994) pp. 335–348.
*Kirk–Othmer's Encyclopedia of Chemical Technology*, 4th ed., New York, John Wiley & Sons, 1995. pp. 1049–1092.
Davis, L.B., *Dry Low $NO_x$ Combustion Systems For GE Heavy–Duty Gas Turbines*, Schenectady, N.Y., GE Company, 1996. pp. 1–16.

* cited by examiner

*Primary Examiner*—Louis J. Casaregola
(74) *Attorney, Agent, or Firm*—Thomas A. Yassen

(57) ABSTRACT

A method of generating power by passing a dimethyl ether-containing fuel to a dry low $NO_x$ combustor of a fired turbine-combustor in the presence of an oxygen-containing gas for combustion in the combustor to form flue gas, and then passing the flue gas to the turbine to generate power, wherein the fuel comprises a mixture of dimethyl ether, at least one alcohol and, optionally, a component selected from the group consisting of water and $C_1$–$C_6$ alkanes. The fuel composition used in the inventive method permits a safe and highly efficient operation of a dry low $NO_x$ combustion system, while at the same time, minimizing the generation of $NO_x$ and carbon monoxide emissions.

19 Claims, 6 Drawing Sheets

METHOD OF GENERATING POWER IN A DRY LOW $NO_X$ COMBUSTION SYSTEM

BACKGROUND OF THE INVENTION

1. Field of the Invention

The invention relates to the generation of power. More specifically, the invention relates to the generation of power using a dimethyl ether fuel composition in a dry low $NO_x$ combustion system of a turbine.

2. Brief Description of Related Technology

The use of hydrocarbon fuels in a combustor of a fired turbine-combustor is well known. Generally, air and a fuel are fed to a combustion chamber where the fuel is burned in the presence of the air to produce hot flue gas. The hot flue gas is then fed to a turbine where it cools and expands to produce power. By-products of the fuel combustion typically include environmentally harmful toxins, such as nitrogen oxide and nitrogen dioxide (collectively called $NO_x$), carbon monoxide, unburned hydrocarbons (e.g., methane and volatile organic compounds that contribute to the formation of atmospheric ozone), and other oxides, including oxides of sulfur (e.g., $SO_2$ and $SO_3$).

The specific fuel composition, the amount of air, the particular type of combustion system, and the processing conditions are among many variables that influence the overall efficiency of the process. In addition to maximizing the overall efficiency of the process, the ability to minimize the amount of environmentally harmful toxins produced as by-products of the fuel combustion is of great importance.

There are two sources of $No_x$ emissions in the combustion of a fuel. The fixation of atmospheric nitrogen in the flame of the combustor (known as thermal $NO_x$) is the primary source of $NO_x$. The conversion of nitrogen found in the fuel (known as fuel-bound nitrogen) is a secondary source of $NO_x$ emissions. The amount of $NO_x$ generated from fuel-bound nitrogen can be controlled through appropriate selection of the fuel composition, and post-combustion flue gas treatment. The amount of thermal $NO_x$ generated is an exponential function of the combustor flame temperature and the amount of time that the fuel mixture is at the flame temperature. Each air-fuel mixture has a characteristic flame temperature that is a function of the air-to-fuel ratio (expressed as the equivalence ratio, $\phi$) of the air-fuel mixture burned in the combustor. Thus, the amount of thermal $NO_x$ generated is based on the residence time and the equivalence ratio of a particular air-fuel mixture. The equivalence ratio ($\phi$) is defined by the following ratio:

$$\phi = \frac{(m_f/m_o)_{actual}}{(m_f/m_o)_{stoichiometric}}$$

where $m_o$ is the mass of the oxidizer and $m_f$ is the mass of the fuel.

The rate of $NO_x$ production is highest at an equivalence ratio of 1.0, when the flame temperature is equal to the stoichiometric, adiabatic flame temperature. At stoichiometric conditions, the fuel and oxygen are fully consumed. Generally, the rate of $NO_x$ generation decreases as the equivalence ratio decreases (i.e., is less than 1.0 and the air-fuel mixture is fuel lean). At equivalence ratios less than 1.0, more air and therefore, more oxygen is available than required for stoichiometric combustion, which results in a lower flame temperature, which in turn reduces the amount of $NO_x$ generated. However, as the equivalence ratio decreases, the air-fuel mixture becomes very fuel-lean and the flame will not burn well, or may become unstable and blow out. When the equivalence ratio exceeds 1.0, there is an amount of fuel in excess of that which can be burned by the available oxygen (fuel-rich mixture). This also results in a flame temperature lower than the adiabatic flame temperature, and in turn leads to significant reduction in $NO_x$ formation.

In order to accommodate fuel-lean mixtures and to avoid the existence of unstable flames and the possibility of flame blow outs, combustors wherein only a portion of the flame-zone air is allowed to mix with the fuel at lower loads have been developed. These combustor systems are known in the art as "dry low $NO_x$" (hereinafter "DLN") systems and are manufactured by General Electric Company and Westinghouse, for example. In addition to providing the user with the operability benefits described above, DLN systems also minimize the generation of $NO_x$, carbon monoxide, and other pollutants.

A DLN combustor is generally known as a type of staged combustor in which a fraction of the flame zone air is mixed with the fuel at low loads or during start-up. There are two types of staged combustors: fuel-staged and air-staged. In its simplest configuration, a fuel-staged combustor has two flame zones, each of which receives a constant fraction of the combustor airflow. The fuel flow is divided between the two zones such that, at each combustor operational mode, the amount of fuel fed to a stage is matched with the amount of air available. In contrast, an air-staged combustor uses a mechanism for diverting a fraction of the combustor airflow from the flame zone to a dilution zone at low loads to increase turndown. These two types of staged combustors can be combined into a single system.

A DLN system typically operates in the following four distinct modes: primary, lean-lean, secondary, and pre-mix. In the "primary" mode of operation, a fuel is fed to primary nozzles in the primary stage of the system. A flame, referred to in this mode as a "diffusion flame," is only present in the primary stage. In this mode, the flame will tend to be located where the local air-fuel mixture is in a substantially 1:1 proportion so that the oxygen is completely consumed in the reaction (stoichiometric mixture, as noted above). This will be the case even if the overall air-to-fuel ratio in the flame zone may be fuel lean ($\phi$<1.0). This mode of operation is commonly used to ignite, accelerate, and operate the machine over low- to mid-loads (e.g., 0% to 20% loads using a natural gas fuel), up to a predetermined combustion reference temperature. $NO_x$ and carbon monoxide emissions generated in this mode are relatively quite high. The $NO_x$ emissions are driven by the peak temperatures in the flame, and a stoichiometric mixture will produce the hottest flame possible at given combustion conditions.

In the "lean-lean" mode, a fuel is fed to the primary and secondary nozzles. A flame is present in both the primary and secondary stages. This mode of operation is commonly used for intermediate loads (e.g., 20% to 50% loads using a natural gas fuel), between two predetermined combustion reference temperatures. Here, also, $NO_x$ emissions are rather high.

In the "secondary" mode, a fuel is fed only to the secondary nozzles and a flame exists only in the secondary stage. This mode of operation is typically a transitional mode between the "lean-lean" and "pre-mix" modes. The secondary mode is required to extinguish the flame in the primary stage before any fuel may be introduced into what becomes the primary pre-mixing zone.

The fourth operational mode is known as the "pre-mix" mode. Here a fuel is fed to both the primary and secondary nozzles, however the flame only exists in the secondary stage. Only about 20% of the fuel is fed to the secondary nozzles while the balance is fed to the primary nozzles along with air for "pre-mixing" prior to combustion. The first stage serves to thoroughly mix the fuel and air, and to deliver a uniform lean, unburned air-fuel mixture to the second stage. If properly designed and operated, there should be no regions of stoichiometric or near-stoichiometric air-fuel mixtures entering the flame zone and, therefore, the flame will be cooler than the adiabatic flame temperature, and produce substantially less $NO_x$ than a diffusion flame burning in the presence of an air-fuel mixture with the same equivalence ratio. The pre-mix mode is commonly thought of as the most efficient operational mode because it is in this mode that the $NO_x$ emissions are at a minimum and power generation is at a maximum (e.g., 50% to 100% loads using a natural gas fuel).

For power generation using gas turbines, DLN combustor systems are specifically designed to use natural gas (mostly methane, with varying amounts of non-methane compounds). For use with liquid petroleum-based distillate fuels, such combustor systems would require additional steam injection to reduce $NO_x$ and CO emissions. For power generation using gas turbines, other types of fuels, such as methanol or dimethyl ether manufactured from natural gas, coal, or biomass, which are amenable for ocean transportation or storage as a liquid fuel for peak power use, have also been proposed. For example, Bell, et al. U.S. Pat. No. 4,341,069 (issued Jul. 27, 1982) discloses the use of dimethyl ether mixed with small amounts of methanol (1.8 wt. % to 6.1 wt. %) and water (0.6 wt. % to 2.8 wt. %). Such fuels were formulated for use in combustion systems during an era when $NO_x$ emissions were not strictly regulated. The use of such fuels in conventional gas turbine combustors (designed specifically for natural gas fuels) operating under a diffusion flame mode could satisfy the lax $NO_x$ emissions standards of the past; however, use of these same fuels in a DLN system operating in a pre-mix mode may result in a high risk of flame flashback and a high risk of explosion. During flame flashback, the speed at which a flame propagates through the air-fuel mixture in the flame zone is higher than the speed of the air-fuel mixture at a given location in the primary mixing zone. As a result, DLN systems designed to burn conventional natural gas fuels will not operate in their most efficient mode, namely the pre-mix mode, with the dimethyl ether fuels, such as those disclosed in the Bell et al. patent.

It would therefore be desirable to provide a dimethyl ether-based fuel which can improve the efficiency of a DLN combustion system (e.g., operate in a pre-mix mode at loads below 50%). It would also be desirable to provide a fuel that can be used safely in a DLN combustor designed specifically to burn conventional natural gas fuels.

SUMMARY OF THE INVENTION

It is an object of the invention to overcome one or more of the problems described above.

Accordingly, the invention provides dimethyl ether-containing fuel compositions and methods of generating power utilizing such compositions.

The fuel compositions of the invention are blends of dimethyl ether, at least one alcohol and, optionally, one or more of a selected $C_1$–$C_6$ alkane and water.

According to the method of the invention, the inventive fuel is mixed with an oxygen-containing gas for combustion in a dry low $NO_x$ combustor of a fired turbine-combustor to generate a flue gas, which is passed to a turbine to generate power.

Other objects and advantages of the invention will be apparent to those skilled in the art from a review of the following detailed description, taken in conjunction with the drawings and the appended claims.

DETAILED DESCRIPTION OF THE INVENTION

Figure 1:
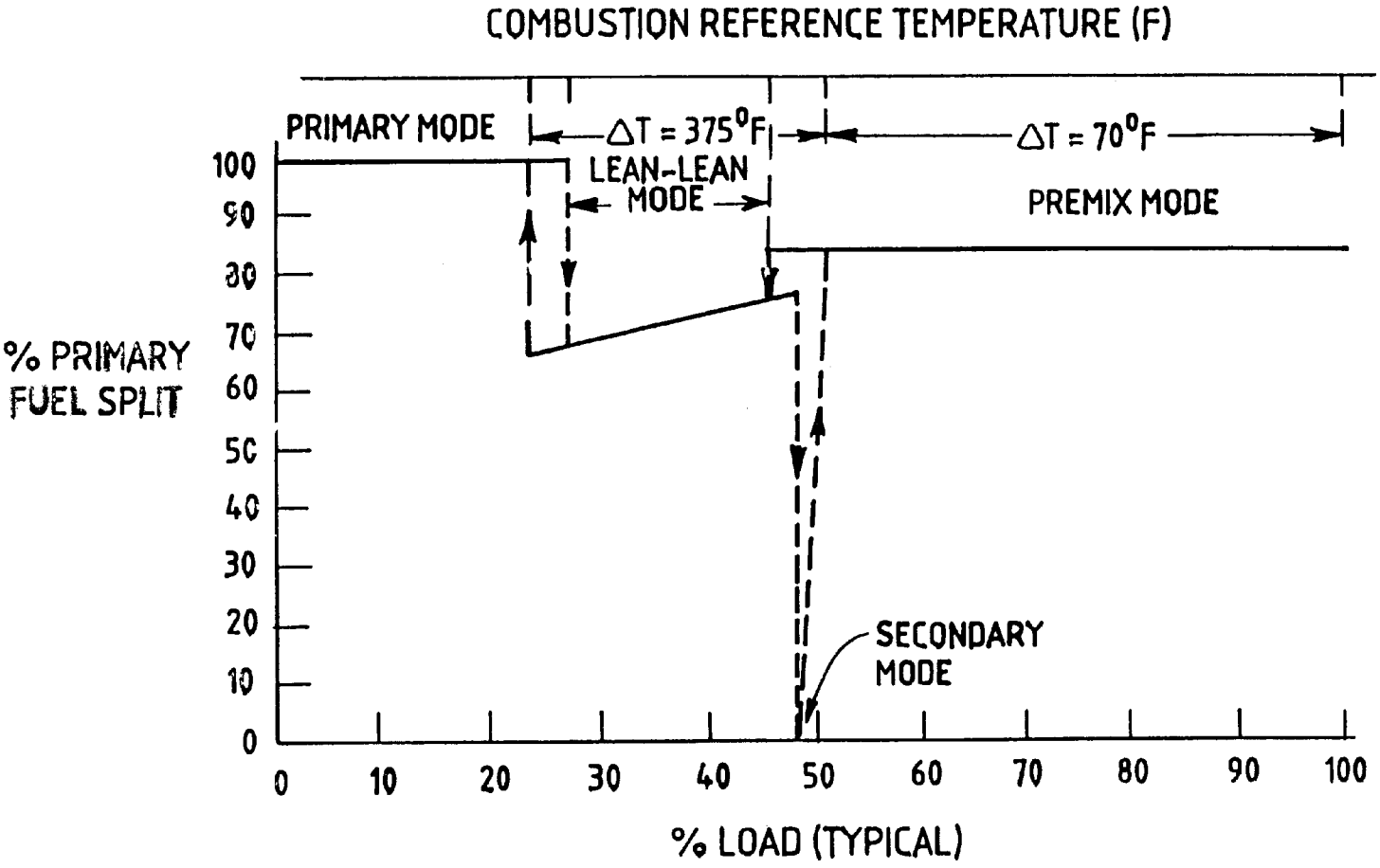
FIG. 1 PRIOR ART
FIG. 1 is a graphical illustration of the operational modes of a typical DLN combustor and the corresponding gas turbine loads for the combustion of a natural gas fuel according to the prior art.

According to the inventive method, power is generated by passing a dimethyl ether-based fuel to a dry low $NO_x$ combustor of a fired turbine-combustor in the presence of an oxygen-containing gas for combustion to form a flue gas, and then passing the flue gas to the turbine of the fired turbine-combustor to generate power. The fuel comprises a mixture of dimethyl ether, an alcohol, and optionally, one or more of water and $C_1$–$C_6$ alkanes.

The inventive fuel composition can be used safely during the pre-mix mode operation of a DLN combustion system designed for conventional natural gas fuels. When the DLN combustor uses this fuel in the pre-mix mode, the risk of flame flashback and the risk of explosion are greatly reduced, while at the same time, a minimal amount of $NO_x$ emissions are generated. Further, use of the inventive fuel in a DLN combustor enables safe pre-mix mode operation with low $NO_x$/CO emissions at gas turbine loads as low as 35%.

The inventive fuel comprises, and preferably consists or consists essentially of, 15 wt. % to 93 wt. % dimethyl ether, 7 wt. % to 85 wt. % of at least one alcohol, and 0 wt. % to 50 wt. % of at least one component selected from the group consisting of water and $C_1$–$C_6$ alkanes. Preferably, the fuel comprises 50 wt. % to 93 wt. % dimethyl ether, 7 wt. % to 50 wt. % of at least one alcohol, and 0 wt. % to 30 wt. % of at least one component selected from the group consisting of water and $C_1$–$C_6$ alkanes. More preferably, the fuel comprises 70 wt. % to 93 wt. % dimethyl ether, 7 wt. % to 30 wt. % of at least one alcohol, and 0 wt. % to 20 wt. % of at least one component selected from the group consisting of water and $C_1$–$C_6$ alkanes. Most preferably, the fuel comprises 80 wt. % to 93 wt. % dimethyl ether, 7 wt. % to 20 wt. % methanol, and 0 wt. % to 10 wt. % of a component selected from the group consisting of water, methane, propane, and liquified petroleum gas.

The presence of water and one or more alcohols in the inventive fuel can be attributed to the conversion of a raw synthesis gas to a DME-based fuel. Water and alcohols, such as, for example, methanol, ethanol, and propanol, may be formed in the conversion and remain a part of the DME-based fuel. Expensive unit operations for the manufacture of the inventive fuel, however, are not necessary as the concentration of the alcohols and water in the DME-based fuel may be easily adjusted to achieve the inventive fuel composition. $C_1$–$C_6$ alkanes also may be added to arrive at the inventive fuel composition.

In the inventive method, pressurized air from a compressor is mixed with a vaporized fuel in a dry low $NO_x$ combustor where the fuel is burned in the presence of the air to produce hot flue gas. The hot flue gas is then expanded in a turbine to produce energy.

It has been found that the occurrence of flame flashback in a DLN combustor operating in the pre-mix mode is related to the ignition delay time and residence time of the air-fuel mixture in the premixing zone of combustor. The ignition delay time of an air-fuel mixture is the time between the application of a spark or the like and actual ignition of the mixture. This is a very short period of time and the various constituents of the inventive fuel composition alone and/or in combination with each other have been found to increase this period such that for given combustor operating conditions, the ignition delay time of an air-fuel mixture will exceed its residence time. The residence time is related to the air-to-fuel ratio in the combustor, the combustor geometry, as well as the operating temperatures and pressures of the combustor.

Furthermore, it has been found that the ignition delay time is a function of the specific composition of the fuel fed to the combustor as well as the combustor operating conditions (e.g., temperature, pressure, dynamic pressures, etc.). For a given equivalence ratio, and combustor geometry, flame flashback is more likely to occur during combustion of a fuel having a shorter ignition delay time than a different fuel having a longer ignition delay time. Flame flashback can be minimized if the ignition delay time of the air-fuel mixture at the combustor operating conditions exceeds its residence time in the premixing section. Accordingly, another preferred embodiment of the invention provides an improved method of generating power in a fired turbine-combustor having a dry low $NO_x$ combustor wherein a fuel and oxygen-containing gas mixture is burned in the combustor, the mixture having a residence time in the combustor and an ignition delay time, the improvement wherein the fuel comprises a mixture of (a) dimethyl ether, (b) an alcohol and, optionally, (c) at least one component selected from the group consisting of water and $C_1$–$C_6$ alkanes, and wherein the respective proportions of (a), (b) and, if present, (c) are selected such that the ignition delay time of the fuel-gas mixture under the operating conditions of the combustor exceeds its residence time.

During operation of a DLN combustor, certain processing conditions contribute to the overall minimization of flame flashback. One particular processing condition is the dynamic pressure activity. Dynamic pressure activity refers to pressure gradients found throughout the combustion chamber. High dynamic pressure levels increase the probability of flame flashback in the air-fuel pre-mix zone. Typically, pre-mix mode operation is unsafe and undesirable where the dynamic pressure levels exceed about 4 psi to about 5 psi.

Figure 2:
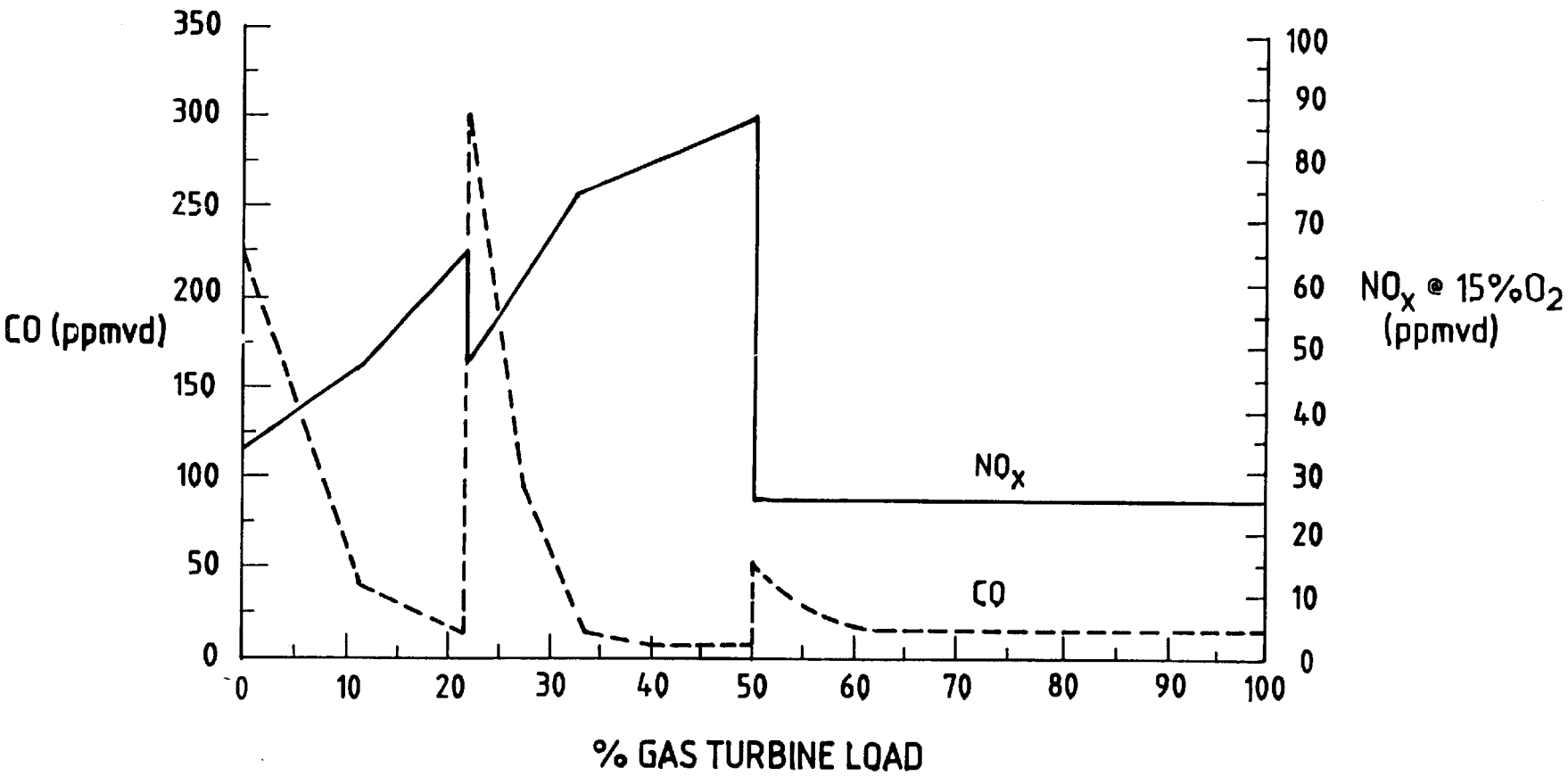
FIG. 2 PRIOR ART
FIG. 2 is a graphical illustration of the $NO_x$ and CO emissions produced by the combustion of a natural gas fuel in a typical DLN combustor according to the prior art.

The load ranges associated with each operational mode indicate that the pre-mix mode is typically used for loads of 50% to 100%. As shown in FIG. 1 for combustion of a natural gas fuel, the combustion reference temperature drops progressively as turbine load is reduced from the pre-mix mode to the secondary mode to the lean-lean mode to the primary mode. FIG. 2 shows that $NO_x$ emissions for the combustion of a natural gas fuel are considerably lower during pre-mix mode operation compared to other operational modes which operate at loads lower than 50%.

Figure 3:
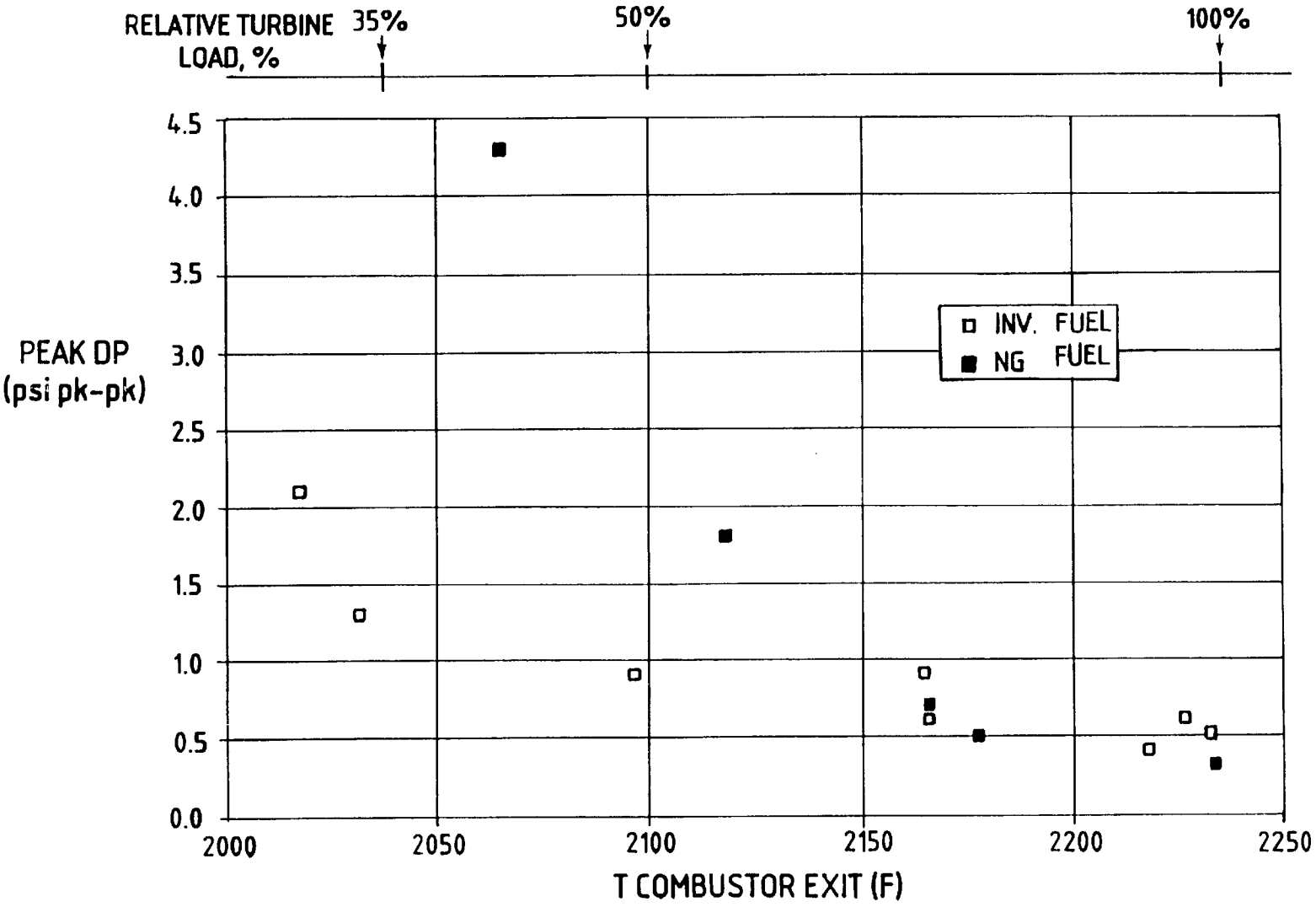
FIG. 3 is a graphical illustration of peak pressure changes found in a typical DLN combustor at various combustor exit temperatures for a natural gas fuel and for a fuel according to the invention.

For a specific DLN combustor, FIG. 3 shows a plot of combustor exit temperature (hereafter "CET") versus dynamic pressure levels for a natural gas fuel (NG FUEL) and for a fuel according to the invention (INV. FUEL). The combustion of a natural gas fuel at CETs below 2150° F. results in dynamic pressures levels (measured as peak pressure change) far in excess of that experienced during combustion of the fuel according to the invention. Specifically, the dynamic pressure levels for the combustion of a natural gas fuel at a CET of 2065° F. is about 4.3 psi, while the dynamic pressure level for the combustion of the fuel according to the invention is only about 1 psi.

Even at a CET of 2020° F., "pre-mix mode" dynamic pressure levels experienced during the combustion of the fuel according to the invention remain considerably below the 4 psi to 5 psi level believed to be unsafe. Thus, the fuel according to the invention provides a dramatic improvement over the art in that it is now possible to operate a DLN combustor in a pre-mix mode at temperatures near 2020° F. which is well below the 50% turbine load limit set for natural gas. This is a significant advantage over fuels in the art since the use of the fuel according to the invention allows pre-mix mode operation of a DLN combustor at loads below 40%, resulting in more efficient combustor operation at lower loads. The ability to operate the combustor at such low loads achieves reduced $NO_x$ emissions for a wider load turndown range.

Figure 4:
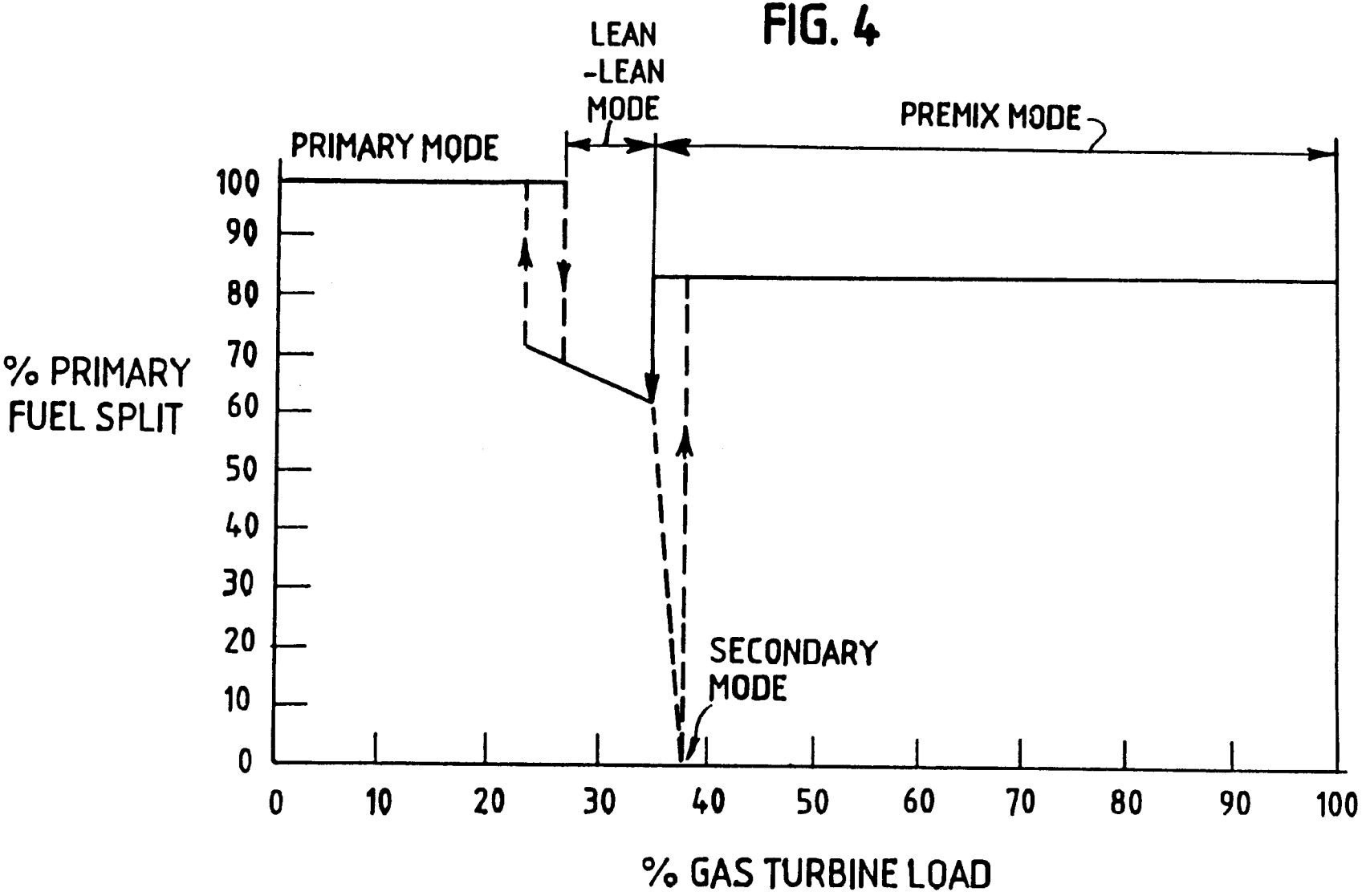
FIG. 4 is a graphical illustration of the operational modes of a typical DLN combustor and the corresponding loads for the combustion of the fuel of the invention.
Figure 5:
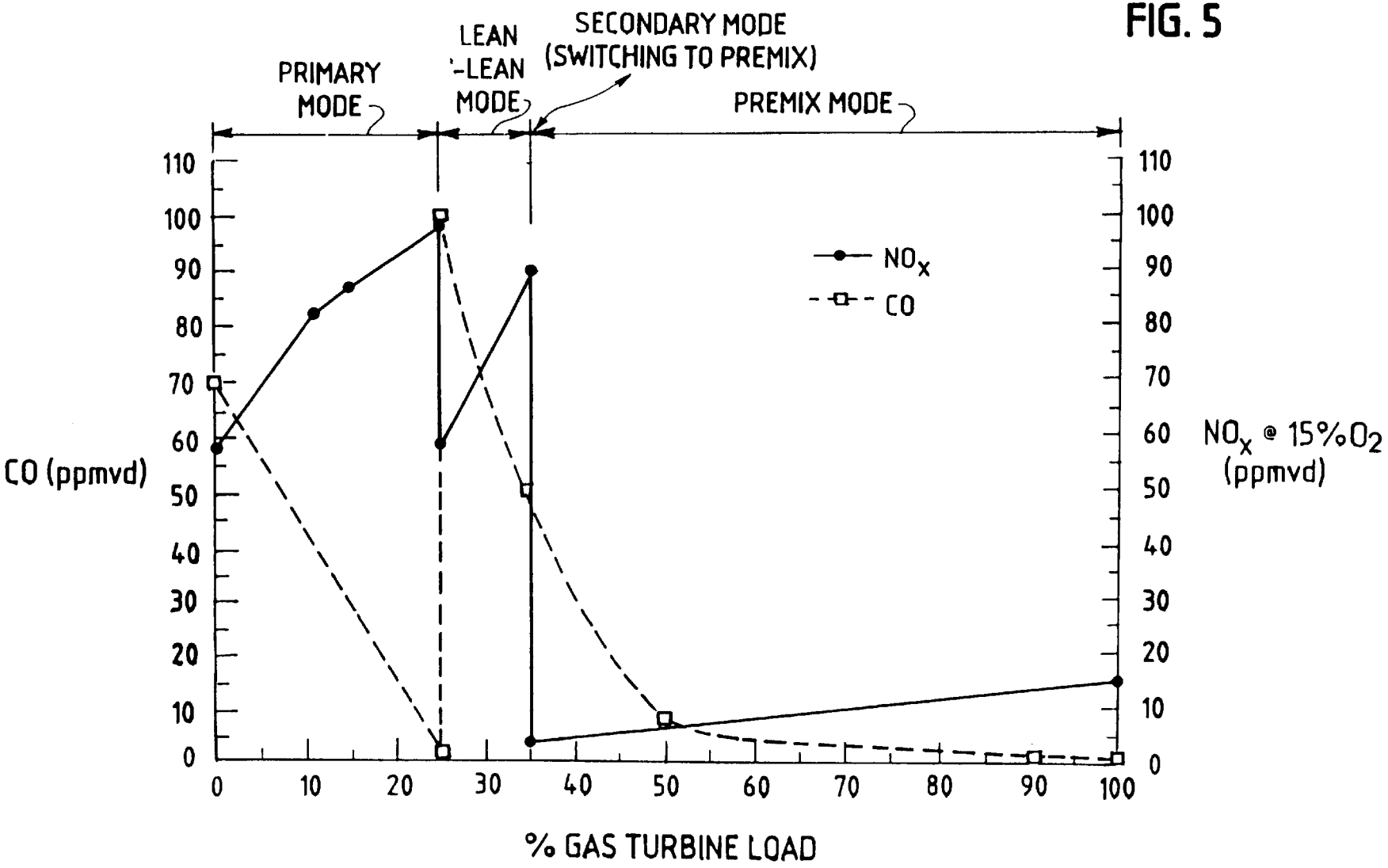
FIG. 5 is a graphical illustration of the $NO_x$ and CO emissions produced by the combustion of the inventive fuel in a typical DLN combustor.

Improvements achieved by the combustion of the inventive fuel in a DLN combustor are apparent by a comparison of the plots illustrated in FIGS. 4 and 5 with those shown in FIGS. 1 and 2, respectively. FIG. 4 is a plot of fuel split versus load and further describes the particular DLN combustor operational modes when burning a fuel according to the invention. As shown in FIG. 4, and when contrasted with a similar plot for natural gas fuel shown in FIG. 1, it is apparent that a DLN combustor burning a fuel according to the invention can operate in a pre-mix mode at significantly lower turbine loads than one burning a natural gas fuel.

Reduced emissions achieved by the combustion of the inventive fuel in the pre-mix mode are graphically illustrated in FIG. 5, which is a plot of carbon monoxide and $NO_x$ emissions generated by the combustion of a fuel according to the invention at various loads and DLN combustor operational modes. Thus, combustion of the inventive fuel under the pre-mix mode operating conditions of the combustor, results in a flue gas having 20 ppmvd (parts per million dry volume basis) or less of $NO_x$ at an oxygen level of 15 vol. % in the flue gas and/or 20 ppmvd or less of carbon monoxide at turbine loads higher than about 40%. Hence, another preferred embodiment of the invention provides an improved method of generating power in a fired turbine-combustor having a dry low $NO_x$ combustor wherein a mixture of fuel and an oxygen-containing gas is passed through the combustor for combustion of the fuel therein to produce a flue gas, and wherein the fuel comprises a mixture of (a) dimethyl ether, (b) an alcohol and, optionally, (c) one or more component selected from the group consisting of water and $C_1$–$C_6$ alkanes, wherein the respective proportions of (a), (b) and, if present, (c) are selected such that the flue gas produced under the operating conditions of the combustor has 20 ppmvd or less of $NO_x$ and/or 20 ppmvd or less of carbon monoxide.

Figure 6:
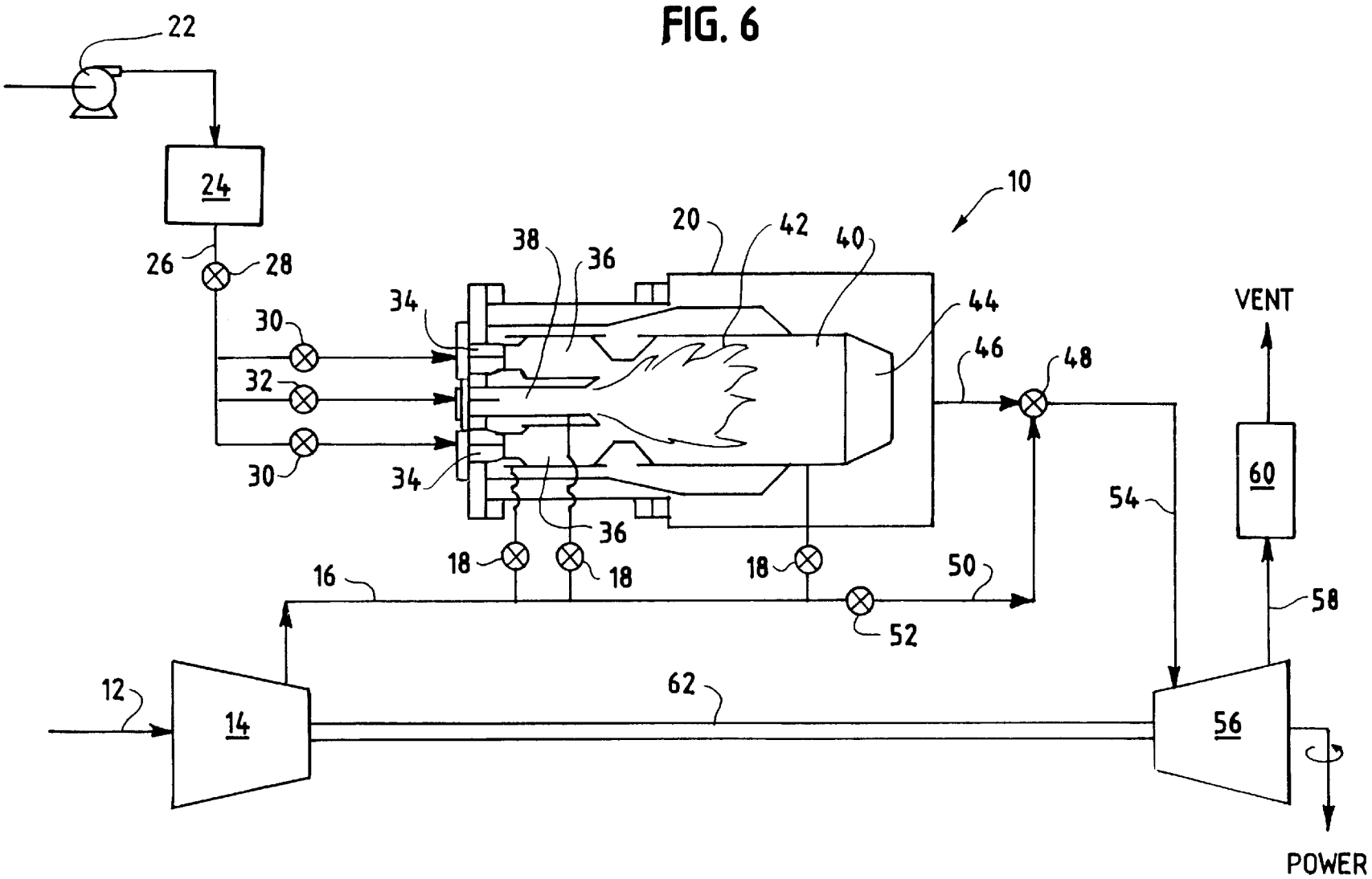
FIG. 6 is a schematic diagram illustrating a gas-fired turbine-combustor process comprising a DLN combustor used to generate power according to the invention.

FIG. 6 schematically illustrates a dry low $NO_x$ combustion system, generally designated 10, for use in generating power. Air is fed through a line 12 to a compressor 14, where the air is pressurized. The pressurized air exits the compressor 14 through a line 16. This air is then fed through valves 18 to a combustor, generally designated 20. Liquid fuel is pumped from a fuel source (not shown) by a pump 22 to a vaporizer 24 where the liquid fuel is vaporized. The vaporized fuel is then fed to the combustor 20 through a feed line 26. The amount of vaporized fuel fed to the combustor 20 is controlled by valves 28, 30, and 32. The valve 28 controls the total flow of fuel to the combustor 20, while the valves 30 control the amount of fuel fed through primary nozzles 34 to primary zones 36 of the combustor 20, and the valve 32 controls the amount of fuel fed through a secondary nozzle 38 to a secondary zone 40 of the combustor 20. The vaporized fuel is mixed with the compressed air in the combustor 20 where it is burned to produce ho t flue gas. During a pre-mix mode operation of the DLN combustion system 10, about 20% of the fuel fed to the combustor 20 may be introduced into the combustor 20 through the secondary fuel nozzle 38, with the balance being fed through the primary fuel nozzles 34. In the pre-mix mode, a part of the compressed air is pre-mixed with the vaporized fuel in the primary zone 36 prior to combustion. In the pre-mix mode, and as shown in FIG. 6, a flame 42 exists only in the secondary zone 40.

The hot flue gas exits the combustor 20 through a combustor discharge zone 44 and then through an exhaust line 46. This flue gas may be combined in a mixer 48 with pressurized air from an air by-pass line 50 leading from the compressor 14 through the line 16 and a valve 52. The flue gas is then fed through a line 54 to a turbine 56 where it expands to near atmospheric pressure, thereby producing mechanical power. The expanded and cooled flue gas exiting the turbine 56 through a line 58 is vented through an exhaust stack 60. As shown in FIG. 6, mechanical power generated by the turbine 56 may be used to power the compressor 14 by a shaft 62.

Relationship Between Fuel Constituents and Ignition Delay Time

Described in more detail below is a procedure (and the results obtained therefrom) used to determine a fuel composition having a suitable ignition delay time for safe operation of a DLN combustor. In general, it has been found that the fuel according to the invention has an ignition delay time t hat allows for the safe and efficient operation of a DLN combustion system.

Experiments to determine the ignition delay time of various fuel compositions were performed in a constant volume combustion apparatus (hereafter "CVCA"), which is designed to simulate the autoignition of fuels in a diesel engine. The measurements from these experiments were then used to determine fuel compositions suitable for use in industrial-size DLN combustors operating in the pre-mix mode.

A CVCA is a stainless steel vessel equipped with a fuel injector, a pressure transducer, and temperature sensors. The combustion chamber of the particular CVCA used was 5.4 cm in diameter and 16.2 cm in length. The chamber geometry, dimensions, and injection system were matched to ensure appropriate air-to-fuel ratios.

Gases such as air and methane were mixed in the combustion chamber of the CVCA before any liquid fuel was injected. The gases entered the chamber tangentially to the wall of the chamber to ensure thorough mixing. Fuel was delivered to the injector through high-pressure tubing by a piston-in-barrel pump, pneumatically driven for a single-shot injection. Fuels such as DME-methanol, DME-water, and DME-propane blends, were delivered under pressure (e.g., 210 psig) to prevent boiling and cavitation during delivery to the injection unit. Each liquid fuel was injected into the combustion chamber, and because the air-fuel mixture was cooler than the initial air temperature, the fuel evaporated and rapidly mixed with the air to form an air-fuel mixture.

Injection and combustion data as well as temperatures and pressures were measured with the aid of a 90 megahertz (MHz) Pentium®-based computer equipped with a Keithley Metrabyte 1801HC high performance card. The card allowed sample rates of up to 330 kilohertz (kHz) at signal gains as high as 50:1. A 5 mm diameter magnetic proximity sensor was installed in the head of the injector to detect the needle lift.

A first set of ignition tests was performed using two fuel samples, one of neat DME (i.e., 100 wt. % DME) and the other comprising blends of DME with water and methanol. A second set of ignition delay tests was performed using four fuel samples, a DME and water blend, a DME and methanol blend, a DME and propane blend, and neat pentane, respectively. All measurements were performed at air-to-fuel ratios of either approximately 0.4 or approximately 1.0. The measurements obtained from the first set of fuel samples are presented in Table I, below.

TABLE I

| Ignition Delay Times (ms) | | | | | |
|---|---|---|---|---|---|
| Temp. (° F.) | Pres. (psig) | Equiv. Ratio | 100% DME 0% MeOH 0% $H_2O$ | 82% DME 15% MeOH 3% $H_2O$ | 87% DME 10% MeOH 3% $H_2O$ |
| 740 | 100 | 1.0 | — | 113 | 72 |
| 740 | 200 | 1.0 | 24 | 103 | 50 |
| 680 | 200 | 1.0 | 72 | 99 | — |
| 740 | 100 | 0.4 | — | 95 | 52 |
| 740 | 200 | 0.4 | 26 | 85 | 66 |
| 680 | 200 | 0.4 | 134 | 165 | — |

The measurements obtained from the second set of fuel samples are presented in Table II, below.

TABLE II

| Ignition Delay Times* (ms) | | | | | |
|---|---|---|---|---|---|
| Temp. (° F.) | Pres. (psig) | 91.84% DME 8.16% $H_2O$ | 91.84% DME 8.16% MeOH | 91.84% DME 8.16 $C_3H_8$ | 0% DME 100% $C_5H_{12}$ |
| 740 | 208.3 | 35.9 | | | |
| 740 | 206.3 | | 41.4 | | |
| 740 | 205.8 | | | 38.4 | |
| 740 | 212.4 | | | | 79.4 |

*All measurements performed with equivalence ratio of 0.4.

Ignition delay time measurements were also performed where neat DME was injected into a combustion chamber that was filled with a premixed air-methane gas. The measurements from these tests are provided in Table III, below.

TABLE III

Ignition Delay Times

| Temp. (° F.) | Pres. (psig) | % of $CH_4$ in Air | Ignition Delay Time (ms) |
|---|---|---|---|
| 802 | 205 | 0 | 30.2 |
| 797 | 204 | 0 | 32.1 |
| 804 | 199 | 0 | 36.0 |
| 802 | 211 | 12 | 52.1 |
| 806 | 211 | 12 | 52.5 |
| 809 | 213 | 12 | 53.5 |
| 799 | 209 | 20 | 67.9 |
| 804 | 210 | 29 | 91.9 |
| 797 | 209 | 29 | 106.6 |
| 795 | 209 | 29 | 108.9 |
| 804 | 209 | 29 | 115.9 |
| 790 | 207 | 29 | 125.3 |

The results of the ignition delay time measurements from Table I show that the DME-methanol-water blends had significantly longer ignition delay times than the neat DME. The results also show that an increase in the methanol content in the DME blend fuel increases the ignition delay time. The results shown in Table II indicate that water and propane were equally effective in increasing the ignition delay time of DME. As shown in Table III, an increase in the methane content in the DME blend fuel also increases the ignition delay time.

EXAMPLES

The following examples illustrate that combustion of a pure DME fuel in a DLN combustion system will result in flame flashback, while combustion of the inventive fuel will not result in flame flashback. The first of the following example test-runs was conducted in an industrial size DLN combustor using a DME blend fuel according to the invention. The second example test-runs were conducted in a laboratory scale DLN combustion system using a pure DME fuel and a DME blend fuel.

Example 1

A liquid fuel mixture consisting of 2.9 wt. % water, 14.2 wt. % methanol, and 82.9 wt. % dimethyl ether was pumped to a vaporizer/superheater unit by two progressive-chamber turbine pumps operating in series. The first pump (known as a transfer pump) pressurized the fuel from about 40–60 psig to about 300 psig. The second pump (known as a booster pump) increased the pressure to 550 psig and pumped the liquid fuel to a vaporizer operating at about 450 psig where the liquid fuel was vaporized.

Compressed air was fed to the DLN combustor at a rate of about 44 pounds per second (lbs/sec) to about 54 lbs/sec. The compressed air temperatures was varied from about 565° F. to 710° F. The pressure inside the DLN combustor was varied from about 120 psia to about 180 psia. The vaporized fuel, having a temperature above 350° F., was injected into the DLN combustor at a rate of about 1.0 weight % to about 4.6 weight % of the rate of air flow.

Results of the combustion testing demonstrated that the DLN combustor designed for natural gas and conventional distillate fuels successfully burned the fuel fed without any flashback problems in the pre-mix mode, and satisfied low emissions requirements (e.g., 15 ppmvd $NO_x$ at 15% oxygen level in the turbine exhaust gas) targeted for natural gas fuels.

As noted above, a fuel's flashback characteristics and overall turbine system operability under commercial combustor operating conditions are typically reflected by the combustor dynamic pressure activity. Here the dynamic pressure activity, even at relatively low loads, remained well below 4 psi, and therefore no flashback occurred.

Example 2

The laboratory-scale combustor tests were performed in a DLN system in "pre-mix" mode operation to compare the flashback problems for two liquid fuels: one a pure dimethyl ether and the other a dimethyl ether blend consisting of 15 weight % methanol, 3 wt % water and 82 wt % dimethyl ether. The key operating conditions are shown in Table IV. For similar combustion conditions, the experiments with pure dimethyl ether indicated severe flashback problems (indicated by the presence of flame in the fuel/air premixing chamber) while those with the dimethyl ether blend fuel did not indicate any such flashback problems.

TABLE IV

Laboratory Scale DLN Combustor Tests (PREMIX MODE)

| FUEL | PURE DME | DME BLEND FUEL |
|---|---|---|
| Pressure (Atm) | 5.2 | 5.2 |
| DME Flow (gal/min) | 1.7–1.8 | 1.7–1.8 |
| Air Flow (lb/sec) | 3.1 | 3.1 |
| Air Temp. (° F.) | 740–750 | 740–750 |
| DME Vapor Temp. (° F.) | 300–310 | 300–310 |
| Flashback Occurred? | Yes | No |

The foregoing description is given for clearness of understanding only, and no unnecessary limitations should be understood therefrom, as modifications within the scope of the invention will be apparent to those skilled in the art.

What is claimed is:

1. A method of generating power, said method comprising the steps of:

(a) passing a fuel to a dry low $NO_x$ combustor of a fired turbine-combustor in the presence of an oxygen-containing gas for combustion to form a flue gas; and (b) passing said flue gas to a turbine of said fired turbine-combustor to generate power, said fuel comprising 15 wt. % to 93 wt. % dimethyl ether, 7 wt. % to 85 wt. % of at least one alcohol, and, 0 wt. % to 50 wt. % of at least one component selected from the group consisting of water and $C_1$–$C_6$ alkanes.

2. The method of claim 1, wherein said dry low $NO_x$ combustor operates in a pre-mix mode.

3. The method of claim 1, wherein said oxygen-containing gas is air.

4. The method of claim 1, wherein a portion of said oxygen-containing gas is passed from the compressor of said fired turbine-combustor directly to said turbine with said flue gas.

5. The method of claim 1, wherein said fuel comprises 50 wt. % to 93 wt. % said dimethyl ether, 7 wt. % to 50 wt. % said alcohol, and 0 wt. % to 30 wt. % of at least one component selected from the group consisting of water and $C_1$–$C_6$ alkanes.

6. The method of claim 1, wherein said fuel comprises 70 wt. % to 93 wt. % said dimethyl ether, 7 wt. % to 30 wt. % said alcohol, and 0 wt. % to 20 wt. % of at least one component selected from the group consisting of water and $C_1$–$C_6$ alkanes.

7. The method of claim 1, wherein said fuel comprises 80 wt. % to 93 wt. % said dimethyl ether, 7 wt. % to 20 wt. % said alcohol, and 0 wt. % to 10 wt. % of at least one component selected from the group consisting of water and $C_1$–$C_6$ alkanes.

8. The method of claim 1, wherein said alcohol is selected from the group consisting of methanol, ethanol, and propanol.

9. The method of claim 1, wherein said component is selected from the group consisting of water, methane, propane, and liquified petroleum gas.

10. The method of claim 1, wherein said fuel composition comprises 80 wt. % to 93 wt. % said dimethyl ether, 7 wt. % to 20 wt. % methanol, and 0 wt. % to 10 wt. % of a component selected from the group consisting of water, methane, propane, and liquified petroleum gas.

11. In a method of generating power in a fired turbine-combustor having a dry low $NO_x$ combustor wherein a mixture of fuel and an oxygen-containing gas is passed through said combustor for combustion of said fuel therein, said mixture having a residence time in said combustor and said fuel-gas mixture being characterized by an ignition delay time, the improvement wherein said fuel comprises a mixture of (a) dimethyl ether, (b) an alcohol and, optionally, (c) at least one component selected from the group consisting of water and $C_1$–$C_6$ alkanes, wherein the respective proportions of (a), (b) and, if present, (c) are selected such that the ignition delay time of said fuel-gas mixture under the operating conditions of the combustor exceeds its residence time.

12. In a method of generating power in a fired turbine-combustor having a dry low $NO_x$ combustor wherein a mixture of fuel and an oxygen-containing gas is passed through said combustor for combustion of said fuel therein to produce a flue gas, the improvement wherein said fuel comprises a mixture of (a) dimethyl ether, (b) an alcohol and, optionally, (c) at least one component selected from the group consisting of water and $C_1$–$C_6$ alkanes, wherein the respective proportions of (a), (b) and, if present, (c) are selected such that the flue gas produced under the pre-mix mode operating conditions of the combustor has an $NO_x$ concentration of 20 ppmvd or less at an oxygen level of 15%.

13. In a method of generating power in a fired turbine-combustor having a dry low $NO_x$ combustor wherein a mixture of fuel and an oxygen-containing gas is passed through said combustor for combustion of said fuel therein to produce a flue gas, the improvement wherein said fuel comprises a mixture of (a) dimethyl ether, (b) an alcohol and, optionally, (c) at least one component selected from the group consisting of water and $C_1$–$C_6$ alkanes, wherein the respective proportions of (a), (b) and, if present, (c) are selected such that the flue gas produced under the pre-mix mode operating conditions of the combustor has a carbon monoxide concentration of 20 ppmvd or less.

14. The improvement of claim 11 wherein the fuel comprises a mixture of 15 wt. % to 93 wt. % dimethyl ether, 7 wt. % to 85 wt. % of said alcohol, and 0 wt. % to 50 wt. % of said component (c).

15. The improvement of claim 11 wherein said component (c) is selected from the group consisting of water, methane, propane, and liquified petroleum gas.

16. The improvement of claim 12 wherein the fuel comprises a mixture of 15 wt. % to 93 wt. % dimethyl ether, 7 wt. % to 85 wt. % of said alcohol, and 0 wt. % to 50 wt. % of said component (c).

17. The improvement of claim 12 wherein said component (c) is selected from the group consisting of water, methane, propane, and liquified petroleum gas.

18. The improvement of claim 13 wherein the fuel comprises a mixture of 15 wt. % to 93 wt. % dimethyl ether, 7 wt. % to 85 wt. % of said alcohol, and 0 wt. % to 50 wt. % of said component (c).

19. The improvement of claim 13 wherein said component (c) is selected from the group consisting of water, methane, propane, and liquified petroleum gas.

* * * * *